US005644980A

United States Patent [19]

Kusch et al.

[11] Patent Number: 5,644,980

[45] Date of Patent: Jul. 8, 1997

[54] NUMBERING BOX

[75] Inventors: Hans-Jürgen Kusch, Neckargemünd; Bernd Ruf, Weiterstadt; Rudi Stellberger, Kronau, all of Germany

[73] Assignee: Heidelberger Druck maschinen AG, Heidelberg, Germany

[21] Appl. No.: 567,845

[22] Filed: Dec. 6, 1995

[30] Foreign Application Priority Data

Dec. 7, 1994 [DE] Germany ..... 44 43 516.9

[51] Int. Cl.[6] ..... B41J 1/32

[52] U.S. Cl. ..... 101/72; 101/45

[58] Field of Search ..... 101/72, 184, 183, 101/182, 45

[56] References Cited

FOREIGN PATENT DOCUMENTS 2223686 12/1975 Germany .

*Primary Examiner*—Edgar S. Burr

*Assistant Examiner*—Daniel J. Colilla

*Attorney, Agent, or Firm*—Herbert L. Lerner; Laurence A. Greenberg

[57] ABSTRACT

Provided in a printing press having a printing-press housing and an impression cylinder are a numbering box having a numbering-box shaft for holding numbering devices, an inking device with an ink form roller, and a switching or control device, including telescopic rails mounted in the printing-press housing, the numbering box being disposed on the telescopic rails and being displaceable thereon into and out of engagement with the impression cylinder, and a mechanism for simultaneously effecting mutual engagement and disengagement of the inking device and the numbering-box shaft.

13 Claims, 2 Drawing Sheets

NUMBERING BOX

BACKGROUND OF THE INVENTION

1. Field of the Invention

The invention relates to a numbering box with a numbering-box shaft for holding numbering devices, an inking device with an ink form roller and a switching or control device.

For such a numbering box, it is necessary both that the numbering-box shaft be brought into and out of engagement with the impression cylinder, and also that the inking device to be brought into and out of engagement with the numbering-box shaft. The latter of these switching operations is required because the stopping of a numbering device on the ink form roller would result in the destruction of the latter. Furthermore, simultaneous operation or engagement of the numbering-box shaft and the inking device without the occurrence of any printing (the numbering-box shaft, but not the inking device being disengaged) would result in an over-inking of the numbering device and to premature wear and tear of the ink form roller.

A numbering box has become known heretofore from the brochure entitled "Numerieren mit Heidelberg T-Offset" [Numbering with Heidelberg T-Offset] of the firm Paul Leibinger & Co. KG wherein, in order to solve this technical problem, the numbering-box shaft is brought into or out of engagement with the impression cylinder, and the inking device is brought into or out of engagement with the numbering-box shaft. In the installed condition thereof, however, the numbering-box unit is permanently bolted to the printing press. The numbering-box shaft is swivelably mounted or journalled in the numbering-box unit. Removal or disassembly of the numbering-box unit from the printing press and, accordingly, also the maintenance thereof are complicated and expensive.

SUMMARY OF THE INVENTION

It is therefore an object of the invention to provide an improved numbering device of the type mentioned in the introduction hereto the removal and maintenance of which are performable in a relatively simple and user-friendly manner.

With the foregoing objects in view, there is provided, in accordance with the invention, in a printing press having a printing-press housing and an impression cylinder, a numbering box having a numbering-box shaft for holding numbering devices, an inking device with an ink form roller, and a switching or control device, comprising telescopic rails mounted in the printing-press housing, the numbering box being disposed on the telescopic rails and being displaceable thereon into and out of engagement with the impression cylinder, and a mechanism for simultaneously effecting mutual engagement and disengagement of the inking device and the numbering-box shaft.

In accordance with another feature of the invention, the numbering box includes a switching shaft supported in the printing-press housing, and a first lever for bringing the numbering box into and out of engagement with the impression cylinder through the intermediary of the switching shaft.

In accordance with a further feature of the invention, the numbering box includes a switching shaft supported in the printing-press housing, and a second lever for bringing the inking device into and out of engagement with the numbering-box shaft through the intermediary of the switching shaft.

In accordance with an added feature of the invention, the switching shaft is actuatable through the intermediary of a third lever.

In accordance with an additional feature of the invention, the numbering box includes a pneumatic cylinder disposed on the third lever.

In accordance with yet another feature of the invention, the numbering box includes a switching shaft inserted through the intermediary of coupling elements into the printing-press housing.

In accordance with yet a further feature of the invention, the inking device is of a rocker-type construction and is mounted in a housing of the numbering box, and a lever is provided for swiveling the inking device against a spring force so that it is able to assume the engagement and disengagement positions with respect to the impression cylinder.

In accordance with yet an added feature of the invention, the numbering box includes respective adjustable first and second stops, the lever being in pressing engagement with the first stop for swiveling the inking device, and being limited by the second stop in a returning movement of the lever due to the spring force.

In accordance with yet an additional feature of the invention, the inking device is of a rocker-type construction and is suspended in a housing of the numbering box, and a two-armed lever is suspended coaxially with the rocker-type inking device, a coupling link connecting the two-armed lever by one arm thereof to the printing-press housing, the two-armed lever, with the other arm thereof, being cooperatively engageable with a stop on the inking device, the inking device being swivelable by the stop and by an opposing spring when the numbering box is displaced on the telescopic rails.

In accordance with still another feature of the invention, the numbering box includes a switching shaft supported in the printing-press housing, the coupling link being mounted on the switching shaft.

In accordance with still a further feature of the invention, the numbering box includes a stop limiting positioning travel of the numbering box.

In accordance with a concomitant feature of the invention, the telescopic rails serve additionally for accommodating the numbering box in the printing-press housing.

Such a numbering box can be constructed relatively simply, is economically producible and requires less space than the numbering boxes heretofore known from the prior art. It is a compact unit into which all functional elements are integrated. The element accommodating the unit in the printing press simultaneously serves as a guide element for the switching operation.

A further development of the invention provides that the numbering box be engageable and disengageable by means of a first lever through the intermediary of a switching shaft held in the printing-press housing of the printing press. The first lever may be connected to the housing of the numbering box, effecting displacement on the telescopic rails. It is also possible for the inking device to be engageable and disengageable by means of a second lever through the intermediary of the switching shaft. The required rotational movement of the switching shaft may be accomplished in various ways, one proposal providing that the switching shaft be actuatable through the intermediary of a third lever. It is advantageous, for this purpose, for a pneumatic cylinder to be disposed on the third lever.

Various possibilities are conceivable for the simultaneous operation of the inking device. Two embodiments of the invention are described herein.

A first embodiment provides for the inking device to be of rocker-type construction, be held in the housing of the numbering box and be swivelable by the second lever against the force of a spring so that it is able to assume the engagement and disengagement positions. It is further proposed that the second lever press against a first stop in order to swivel the inking device, and that the return movement due to a spring be limited by a second stop, the stops being adjustable. In this manner, the rotation of the switching shaft effects both the displacement of the numbering box, for bringing the numbering-box shaft into and out of engagement with the impression cylinder, and also the engagement and disengagement of the inking device with respect to the numbering-box shaft. Depending upon the dimensioning of the levers and the stops, as well as the adjustment thereof, both switching operations may take place simultaneously.

Alternatively, it is possible for the engagement and disengagement of the numbering-box shaft and of the inking device to be performed one after the other. For example, it is possible, initially, to bring the inking device into engagement with the numbering-box shaft and then to displace the numbering box with respect to the impression cylinder so that the numbering can be printed.

The second embodiment provides for a two-armed lever mounted coaxially with the mounting of the rocker-type inking device, the two-armed lever being connected at one arm thereof by a link to the printing-press housing and, at its other arm cooperating with a stop on the inking device, the swiveling of the inking device being effected by the stop and the spring when there is a displacement of the numbering box on the telescopic rails. The link may be attached directly to the printing-press housing; alternatively, it may also be mounted on the switching shaft. This last-mentioned embodiment facilitates the installation and removal of the numbering box. Also, with this embodiment, it is possible, through the arrangement of the levers and the stops, as well as the adjustment thereof, for the switching operations to be performed simultaneously or one after the other.

Furthermore, a stop may be provided in the printing-press housing limiting the positioning travel of the numbering box. Furthermore, the telescopic rails may additionally serve to accommodate the numbering box in the printing-press housing.

This double function of the telescopic rails is an especially simple technical solution which simultaneously permits relatively easy installation of the numbering box in the printing press and removal thereof at any time therefrom. In order to permit such a relatively easy installation and removal, it is further advantageous for the switching shaft to be connected by means of coupling elements to the printing-press housing.

Other features which are considered as characteristic for the invention are set forth in the appended claims.

Although the invention is illustrated and described herein as embodied in a numbering box, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
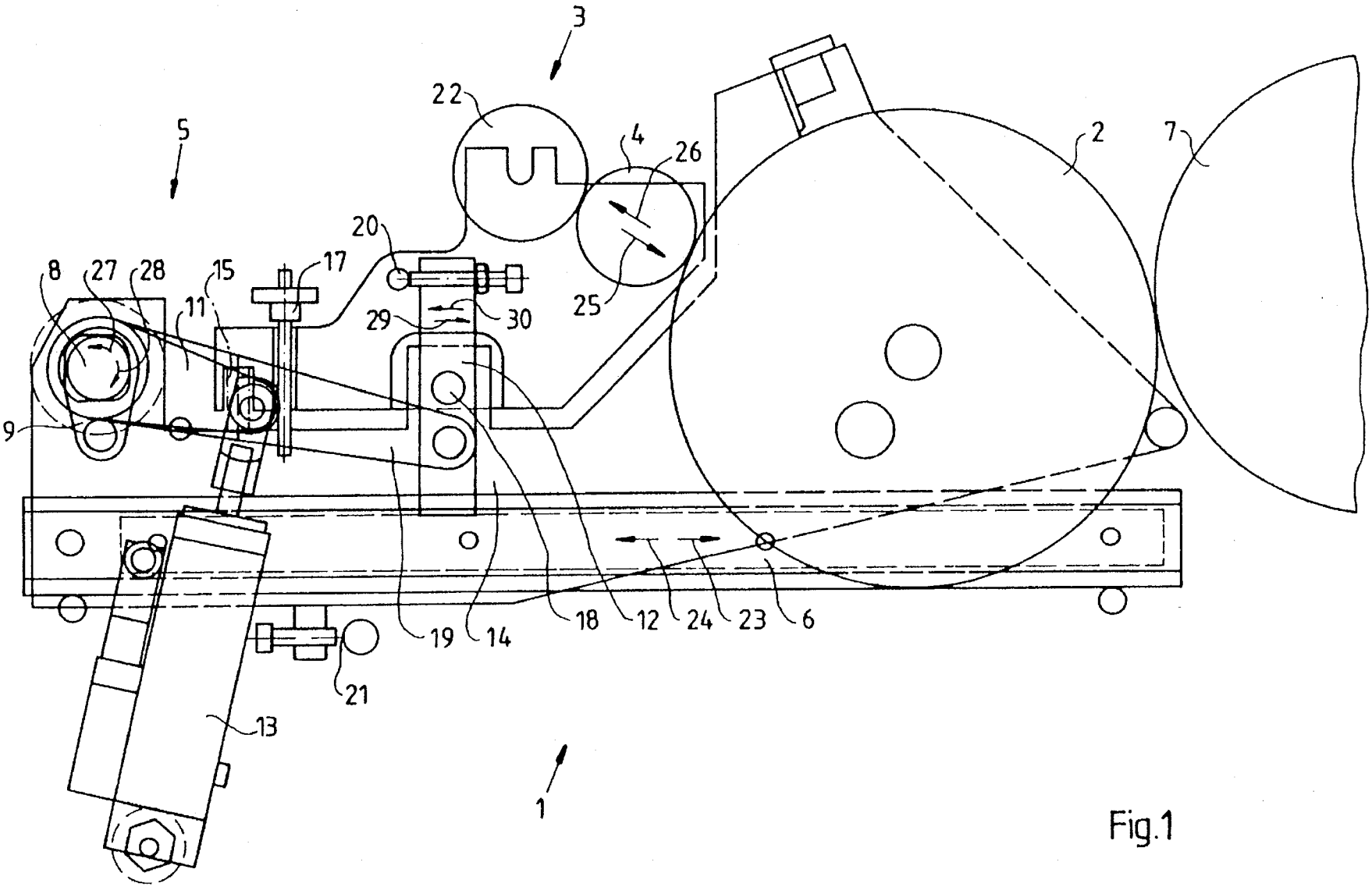
FIG. 1 is a partly broken-away diagrammatic side elevational view of a first embodiment of the numbering box according to the invention.

Referring now to the drawings and, first, particularly to FIG. 1 thereof, there is shown therein a first embodiment of the numbering box 1 according to the invention. The numbering box 1 is manufactured as a unit with the numbering-box shaft 2, the inking device 3 and the switching device 5, the entire unit being accommodated in a housing 14 and being inserted by means of telescopic rails 6 into a non-illustrated housing of a printing press, of which only an impression cylinder 7 is shown in FIG. 1. The numbering-box shaft 2 contained in the numbering box 1 has attached thereto one or more numbering devices which are controlled or switched further by a non-illustrated conventional mechanism for printing various numbers. The numbering devices are inked by the inking device 3 which is formed of an ink form roller 4 and a device for inking the ink form roller 4, such as an ink-storage roller 22, for example.

The housing 14 of the numbering box 1 may be displaced by means of the telescopic rails 6 so that the numbering-box shaft 2 is brought into or out of engagement with the impression cylinder 7. This positioning movement is accomplished through the intermediary of a switching or control shaft 8, which is connected at respective ends thereof by coupling elements to the printing-press housing. When the switching or control shaft 8 is turned, the housing 14 of the numbering box 1 is displaced, through the intermediary of a first lever 9, in the direction of the arrow 23, as a result of which, the numbering-box shaft 2 is brought into engagement with the impression cylinder 7; alternatively, when the displacement is in the direction of the arrow 24, the numbering-box shaft 2 is taken out of engagement with the impression cylinder 7. The rotation or turning of the switching or control shaft 8 is effected through the intermediary of a third lever 11, which is connected to a pneumatic cylinder 13 which, in turn, is attached to the printing-press housing.

Through the intermediary of the switching or control shaft 8, the engagement and disengagement of the inking device 3 with respect to the numbering-box shaft 2 is effected simultaneously. For this purpose, the inking device 3 is connected by a mounting 18 to the housing 14 of the numbering box 1. The inking device 3 is of a rocker-type construction, carries the ink form roller 4, at a forward end of the inking device 3 as viewed from the printing press, and has at a rearward end thereof a spring 15 which is supported on the housing 14 and brings the inking device 3 into engagement with the numbering-box shaft 2 in the direction of the arrow 25. It is possible for this positioning travel to be limited through the intermediary of an adjustable stop 17. The disengagement of the inking device 3 is effected through the intermediary of a two-armed lever 12, which is mounted coaxially with the mounting 18. At the upper end thereof, as viewed in FIG. 1, the two-armed lever 12 cooperates with a stop 20 which is attached to the inking device 3. The positioning movements of the two-armed lever 12 for engagement and disengagement are indicated by the arrows 29 (engagement) and 30 (disengagement).

The positioning movement is communicated to the two-armed lever 12 through the intermediary of a link 19 connecting the lower arm of the two-armed lever 12 to the printing-press housing. This connection is most simply established by the link 19 embracing the switching or control shaft 8 so that the link 19 does not rotate therewith.

The engagement of the inking device 3 is effected by the numbering box 1 being displaced in the direction of the arrow 23, due to which the link 19 operates the two-armed lever 12 in a manner (arrow 29) that the two-armed lever 12 lifts off from the stop 20 and, consequently, the spring 15 brings the inking device 3 into engagement with the numbering-box shaft 2 in the direction of the arrow 25. Conversely, the disengagement of the inking device 3 is effected by the numbering box 1 being moved in the direction of the arrow 24, due to which the link 19 swivels the two-armed lever 12 in a manner that the two-armed lever 12, moving in the direction of the arrow 30, comes up against the stop 20 and, against the force of the spring 15, swivels the inking device 3 away from the numbering-box shaft 2 in the direction of the arrow 26. By an adjustment of the stop 20, it is possible to set or adjust the start of this swiveling-away movement.

A stop 21 disposed on the printing-press housing of the printing press serves to limit the engagement of the numbering-box shaft 2 with the impression cylinder 7. The stop 21 may also be adjustable. The corresponding positioning movements of the switching or control shaft 8 for the engagement and disengagement are identified by the arrows 27 and 28.

Figure 2:
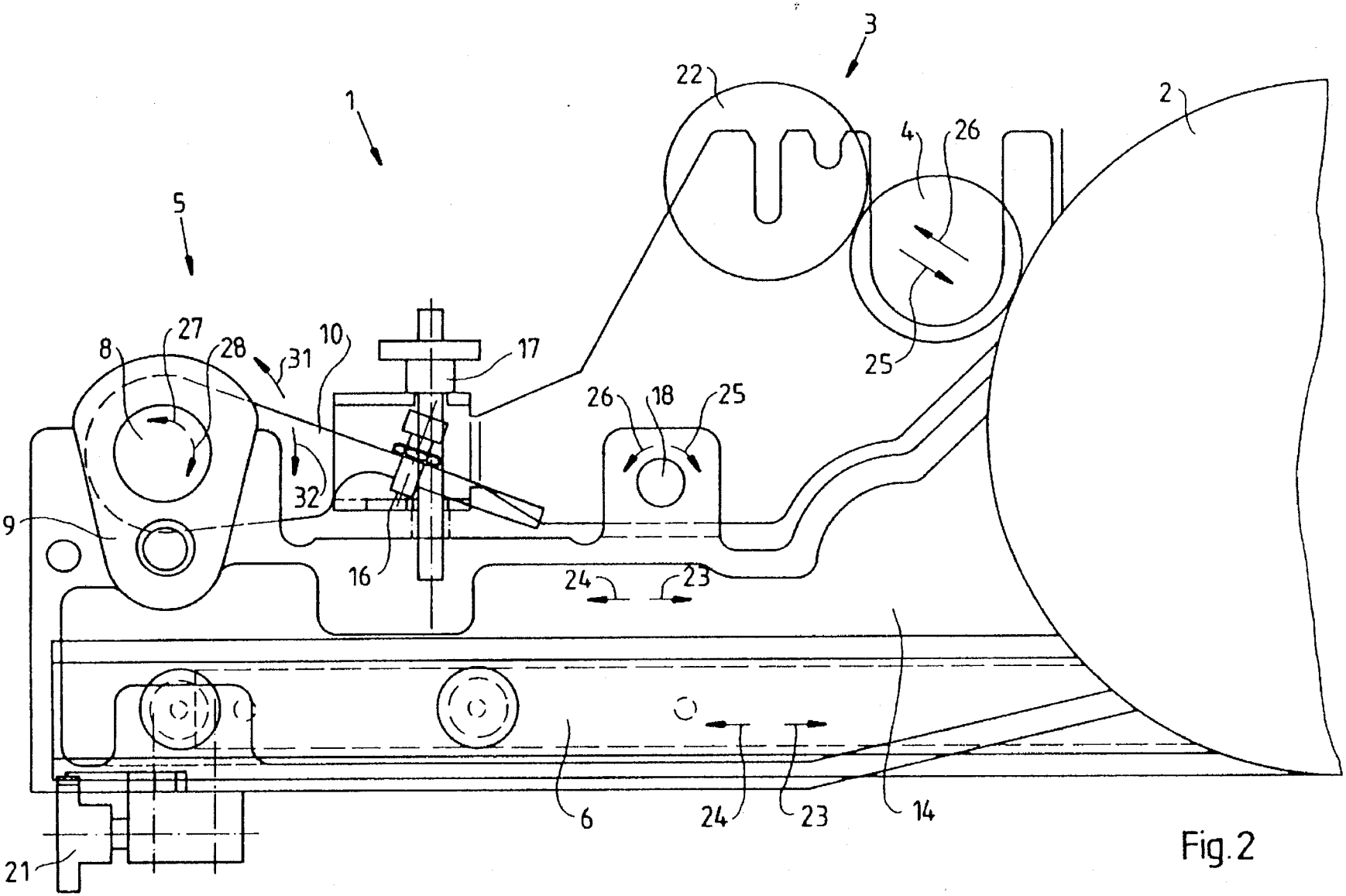
FIG. 2 is a slightly enlarged view similar to that of FIG. 1 of a second embodiment of the inventive numbering box.

FIG. 2 shows another embodiment of the numbering box according to the invention, which also includes the pneumatic cylinder 17 with the third lever 11 although, in the interest of simplicity, they, in addition to the impression cylinder 7, have been omitted from this figure. In FIG. 2, components like those shown in FIG. 1 have been identified by the same reference characters and have the same functions. In contrast with FIG. 1, the mechanism for the engagement and disengagement of the inking device 3 in FIG. 2 is of different construction. That mechanism is made up of a second lever 10, which is permanently connected to the switching or control shaft 8. Once again, the inking device 3 is of a rocker-type construction and is forced into the engagement position thereof by a spring 15. Disengagement is effected through the intermediary of a stop 16 of the lever 10, which swivels the end of the inking device 3 facing away from the impression cylinder 7 against the force of the spring 15, thus moving it in the direction of the arrow 32, as a result of which the inking device 3 is taken out of engagement with the numbering-box shaft 2. Conversely, engagement is effected by the movement of the second lever 10 in the direction of the arrow 31, as a result of which the stop 16 yields or recedes and the inking device 3 is forced by the spring 15 into the engagement position thereof.

In the embodiment of FIG. 2, the simultaneous displacement of the numbering box 1 for engagement and disengagement of the numbering-box shaft 2 with respect to the impression cylinder 7 takes place in the same manner as is described for the embodiment shown in FIG. 1. In the embodiment of FIG. 2 also, there is a stop 21 for limiting the positioning travel of the numbering box 1. However, the stop 21 of FIG. 2 is not attached to the printing-press housing, but rather, is attached directly to the telescopic rails 6.

Of course, further embodiments are conceivable with respect to the mechanism for the simultaneous switching or controlling of the numbering-box shaft 2 and the inking device 3, for example, through the intermediary of cams or cam plates actuatable by the switching or control shaft 8.

We claim:

1. In combination with a printing press having a printing-press housing and an impression cylinder, a numbering box having a numbering-box shaft for holding numbering devices, an inking device with an ink form roller, and a switching or control device, the combination comprising telescopic rails mounted in the printing-press housing, the numbering box being disposed on said telescopic rails and being displaceable thereon into and out of engagement with the impression cylinder, and a mechanism for engaging and disengaging the inking device and the numbering-box shaft simultaneously with the engagement and disengagement, respectively, of the numbering box with the impression cylinder.

2. The combination according to claim 1, including a switching shaft supported in the printing-press housing, and a lever for bringing the numbering box into and out of engagement with the impression cylinder through the intermediary of said switching shaft.

3. The combination according to claim 2, wherein said switching shaft is actuatable through the intermediary of another lever.

4. The combination according to claim 3, including a pneumatic cylinder disposed on said another lever.

5. Numbering box according to claim 1, including a switching shaft supported in the printing-press housing, and a lever for bringing the inking device into and out of engagement with the numbering-box shaft through the intermediary of said switching shaft.

6. The combination according to claim 5, wherein said switching shaft is actuatable through the intermediary of another lever.

7. The combination according to claim 5, including a pneumatic cylinder disposed on said another lever.

8. The combination according to claim 1, including a housing of the numbering box, and wherein the inking device is of a rocker-type construction and is mounted in said housing of the numbering box, and including a lever for swiveling said inking device and a spring bearing against said lever so that said inking device is able to assume the engagement and disengagement positions with respect to the numbering box shaft.

9. The combination according to claim 8, including respective adjustable first and second stops, said lever for swiveling said inking device being in pressing engagement with said first stop, and being limited by said second stop in a returning movement of said lever due to the spring force.

10. The combination according to claim 1, wherein the inking device is of a rocker-type construction and is suspended in a housing of the numbering box, and including a two-armed lever suspended coaxially with the rocker-type inking device, a coupling link connecting said two-armed lever by one arm thereof to the printing-press housing, said two-armed lever, with said other arm thereof, being cooperatively engageable with a stop on the inking device, the inking device being swivelable by said stop and by an opposing spring when the numbering box is displaced on said telescopic rails.

11. The combination according to claim 10, including a switching shaft supported in the printing-press housing, said coupling link being mounted on said switching shaft.

12. The combination according to claim 1, including a switching shaft inserted through the intermediary of coupling elements into the printing-press housing.

13. The combination according to claim 1, including a stop limiting positioning travel of the numbering box.

* * * * *